US007375611B1

(12) United States Patent
Pleskach et al.

(10) Patent No.: US 7,375,611 B1
(45) Date of Patent: May 20, 2008

(54) EMBEDDED STEP-UP TOROIDAL TRANSFORMER

(75) Inventors: Michael D. Pleskach, Orlando, FL (US); Bayardo A. Payan, Melbourne, FL (US); Terry Provo, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/737,359

(22) Filed: Apr. 19, 2007

(51) Int. Cl.
*H01F 27/28* (2006.01)

(52) U.S. Cl. ..... 336/229

(58) Field of Classification Search ..... 336/65, 336/83, 192, 200, 220–223, 225, 229, 232
See application file for complete search history.

(56) References Cited

U.S. PATENT DOCUMENTS 4,649,639 A * 3/1987 Mas ..... 29/605
5,055,816 A * 10/1991 Altman et al. ..... 336/200
5,781,091 A 7/1998 Krone et al.
6,148,500 A * 11/2000 Krone et al. ..... 29/602.1
6,914,509 B2 7/2005 Yu et al.
6,990,729 B2 1/2006 Pleskach et al.
7,158,005 B2 1/2007 Pleskach et al.
7,196,607 B2 3/2007 Pleskach et al.
7,271,697 B2 * 9/2007 Whittaker et al. ..... 336/229
2005/0212642 A1 9/2005 Pleskach

* cited by examiner

*Primary Examiner*—Tuyen T. Nguyen
(74) *Attorney, Agent, or Firm*—Darby & Darby; Robert J. Sacco

(57) ABSTRACT

An embodied step-up toroidal transformer (100). The step-up toroidal transformer (100) includes a plurality of coil segments (102, 104, 106, 108). Each primary coil segment (102, 104, 106, 108) is separately comprised of a plurality of turns of an elongated conductor coiled around a toroidal shaped core (120). The plurality of primary coil segments (102, 104, 106, 108) are collectively disposed around a circumference defined by the toroidal shaped core (120). Each of the plurality of primary coil segments (102, 104, 106, 108) is electrically connected in parallel across a first primary input terminal (128) and a second primary input terminal (130). The step-up toroidal transformer (100) also includes a secondary winding (126) formed from a plurality of turns of a second elongated conductor coiled around the toroidal shaped core (136).

18 Claims, 5 Drawing Sheets

EMBEDDED STEP-UP TOROIDAL TRANSFORMER

BACKGROUND

1. Statement of the Technical Field

The inventive arrangements relate generally to transformers and more particularly to embedded toroidal transformers.

2. Description of the Related Art

Embedded toroidal transformers are known in the art. For example, U.S. Patent Application Publication No. 2005/0212642 to Pleskach discloses an embedded toroidal transformer in a ceramic substrate. The transformer includes a ceramic substrate comprised of a plurality of ceramic tape layers. At least a first one of the ceramic tape layers is layered between a plurality of second ceramic tape layers. The first ceramic tape layer can have a larger permeability value as compared to the second ceramic tape layers. In addition, one or more conductive coils are disposed within the plurality of ceramic tape layers. The conductive coil is of toroidal shape, having a central axis oriented transverse to the ceramic tape layers. Moreover, the conductive coil includes a plurality of turns about a region defining a ceramic toroidal core, wherein the ceramic toroidal core is intersected by the first ceramic tape layer.

Until now, only "step-down" and "one-to-one" toroidal transformers have been successfully embedded in a substrate. However, there are many applications where it is desirable to provide a "step-up" voltage response. In this regard, there have been various attempts at creating a functional step-up transformer. One problem with such embedded toroidal designs lies in that the magnetic flux induced by a primary input coil fails to effectively couple to the secondary output coils. This problem is largely due to the fact that induced magnetic flux in the secondary winding proves difficult to be constrained by metallic vias/traces. Therefore, what is needed is a novel embedded toroidal transformer design that can increase the voltage that is induced in a secondary winding. The novel design should achieve this by containing the magnetic flux that is formed in the secondary. At the same time, the step-up transformer design should not increase the x-y plane size of the toroidal footprint or require any additional machining or post processing steps.

SUMMARY OF THE INVENTION

The present invention is directed to a step-up toroidal transformer. The step-up toroidal transformer comprises a plurality of primary coil segments. Each primary coil segment is separately comprised of a plurality of turns of an elongated conductor coiled around a toroidal shaped core. The plurality of primary coil segments are collectively disposed around a circumference defined by the toroidal shaped core. Each of the plurality of primary coil segments extends a predetermined distance along the circumference of the toroidal shaped core. The plurality of primary coil segments collectively extends an entire distance around the circumference of the toroidal shaped core. The toroidal transformer also includes a first primary input terminal and a second primary input terminal. Each of the plurality of primary coil segments are electrically connected in parallel across the first primary input terminal and the second primary input terminal. More particularly, a first end of each primary coil segment is electrically connected to a first primary input terminal and a second end of each primary coil segment is electrically connected to a second primary input terminal. The plurality of primary coil segments are arranged on the toroidal shaped core so that the first end of each primary coil segment is positioned circumferentially adjacent to the second end of an adjacent one of the primary coil segments.

The turns of the plurality of primary coil segments are contained within a toroidal volume defined by the turns of the secondary winding. Alternatively, the turns of the secondary winding are contained within a toroidal volume defined by the turns of the plurality of primary coil segments. The secondary winding is formed from a plurality of turns of a second elongated conductor coiled around the toroidal shaped core. The secondary winding extends around the circumference defined by the toroidal shaped core. More particularly, the secondary winding extends an entire distance around the circumference of the toroidal shaped core. The secondary winding can comprise an approximately equivalent number of turns about the toroidal shaped core as compared to number of turns collectively provided by the primary coils.

According to an embodiment of the invention, at least one of the primary coil segments and the secondary winding is at least partially embedded in a circuit board. The primary coil segments and the secondary winding are comprised of a plurality of vias disposed within the circuit board. Moreover, selected ones of the vias are electrically connected with conductive traces disposed in or on the circuit board.

A turns ratio of a traditional transformer is the ratio of primary turns to secondary turns $N_p/N_s$. A turns ratio of the toroidal transformer is also determined by the number of the primary coil segments. A modified turns ratio equation for the toroidal can be used $(N_p/N_s)*(1/s)$, where s is the number of primary coil segments connected in parallel. The plurality of primary coil segments are arranged and positioned on the toroidal shaped core so that a magnetic field produced by the plurality of primary coil segments is substantially constrained within the toroidal shaped core. Moreover, the primary coil segments and the secondary winding constrain the magnetic field, regardless of a material forming the toroidal shaped core.

According to another embodiment of the step-up toroidal transformer, the invention comprises a plurality of primary coil segments positioned circumferentially adjacent to each other and respectively coiled about a common toroidal shaped core. The plurality of coil segments collectively extends substantially around an entire circumference defined by the toroidal shaped core. The invention includes a first primary input terminal and a second primary input terminal. Each of the plurality of coil segments is electrically connected in parallel across the first primary input terminal and the second primary input terminal. The invention further includes a secondary winding formed around the toroidal shaped core. The secondary winding extends substantially around the entire circumference of the toroidal shaped core.

DETAILED DESCRIPTION OF THE PREFERRED EMBODIMENTS

Figure 1:
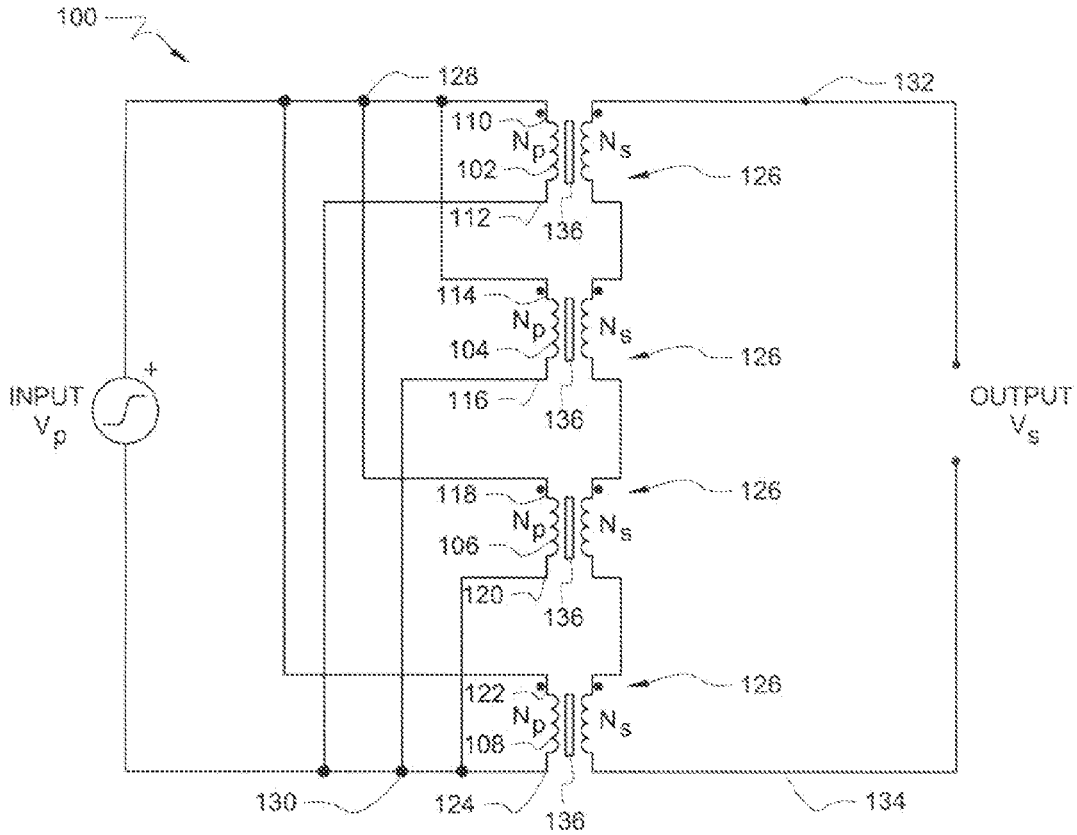
FIG. 1 is an electrical circuit diagram that is useful for understanding a step-up toroidal transformer in accordance with the inventive arrangements.

Referring to FIG. 1, an electrical circuit schematic representation of the step-up toroidal transformer 100 is shown. The transformer 100 comprises a primary winding and a secondary winding. The primary winding is formed of a plurality of primary coil segments 102, 104, 106, 108. As shown in FIG. 1, the primary winding has been divided into four primary coil segments. However, the invention is not limited in this regard and any number of primary coil segments can be used.

A first end 110, 114, 118, 122, of each primary coil segment 102, 104, 106, 108 is respectively connected to a first primary input terminal 128. A second end 112, 116, 120, 124 of each primary coil segment 102, 104, 106, 108 is respectively connected to a second primary input terminal 130. Accordingly, each of the plurality of primary coil segments are electrically connected in parallel across the first primary input terminal 128 and the second primary input terminal 130.

According to a preferred embodiment of the invention, each primary coil segment 102, 104, 106, 108 is comprised of the same number of turns, $N_p$, of an elongated conductor coiled around a core 136. However, the invention is not limited in this regard and more or fewer turns can be used for a particular coil segment. The core 136 can be formed of any suitable material. For example, the core 136 can be formed of air, ceramic, or a ferromagnetic material, such as ferrite. According to one embodiment of the invention which shall be described here in detail, the core can be integrally formed with a ceramic substrate such as LTCC. Substrates formed of other materials can also be used. For example, such materials include, but are not limited to liquid crystals polymer (LCP), polymer film, polyimide film, epoxy laminates, or semiconductor materials such as silicon, gallium arsenide, gallium nitride, germanium or indium phosphide.

The secondary winding 126 is formed of a plurality of turns, $N_S$, of a second elongated conductor. The second elongated conductor is preferably coiled around the same ceramic core as that of the first elongated conductor. Unlike the primary coil segments which are connected in parallel, the secondary winding is formed of a continuous coil. The secondary winding also includes output terminals 132, 134.

When a time-varying input voltage $V_p$ is applied to the primary winding, a current will flow through the primary winding producing a magnetomotive force (MMF). In particular, the above statement is referring to the fact that the same input voltage $V_p$ is being applied across the first primary input terminal 128 and second primary input terminal 130 of each of the four primary coil segments 102, 104, 106, 108. As a result, energy is coupled between the primary coil segments 102, 104, 106, 108 and the secondary winding 126 by the time-varying magnetic flux that passes through both primary and secondary windings. When a time varying current, $I_S$, passes through the primary coil segments 102, 104, 106, 108 an output voltage, $V_S$, is mutually induced in the secondary winding 126.

The time-varying output voltage $V_s$ will be larger than the voltage $V_p$ applied across each of the primary coil segments 102, 104, 106, 108. This is due to the fact that the primary coil segments are arranged in parallel, whereas the all of the turns of the secondary winding 126 are in series. Accordingly, the voltage $V_p$ from each primary coil segment is induced in the secondary winding, and these voltages add in series in the secondary winding 126 to produce a voltage $V_s$. Significantly, for the case where the total number of secondary turns $N_s$ equals the total number of primary turns $N_p$, $V_s$ will be equal to the value of $V_p$, multiplied by the number of primary coil segments. In FIG. 1, there are four primary coil segments 102, 104, 106, 108 so $V_s$ would be equal to 4 $V_p$.

Figure 2:
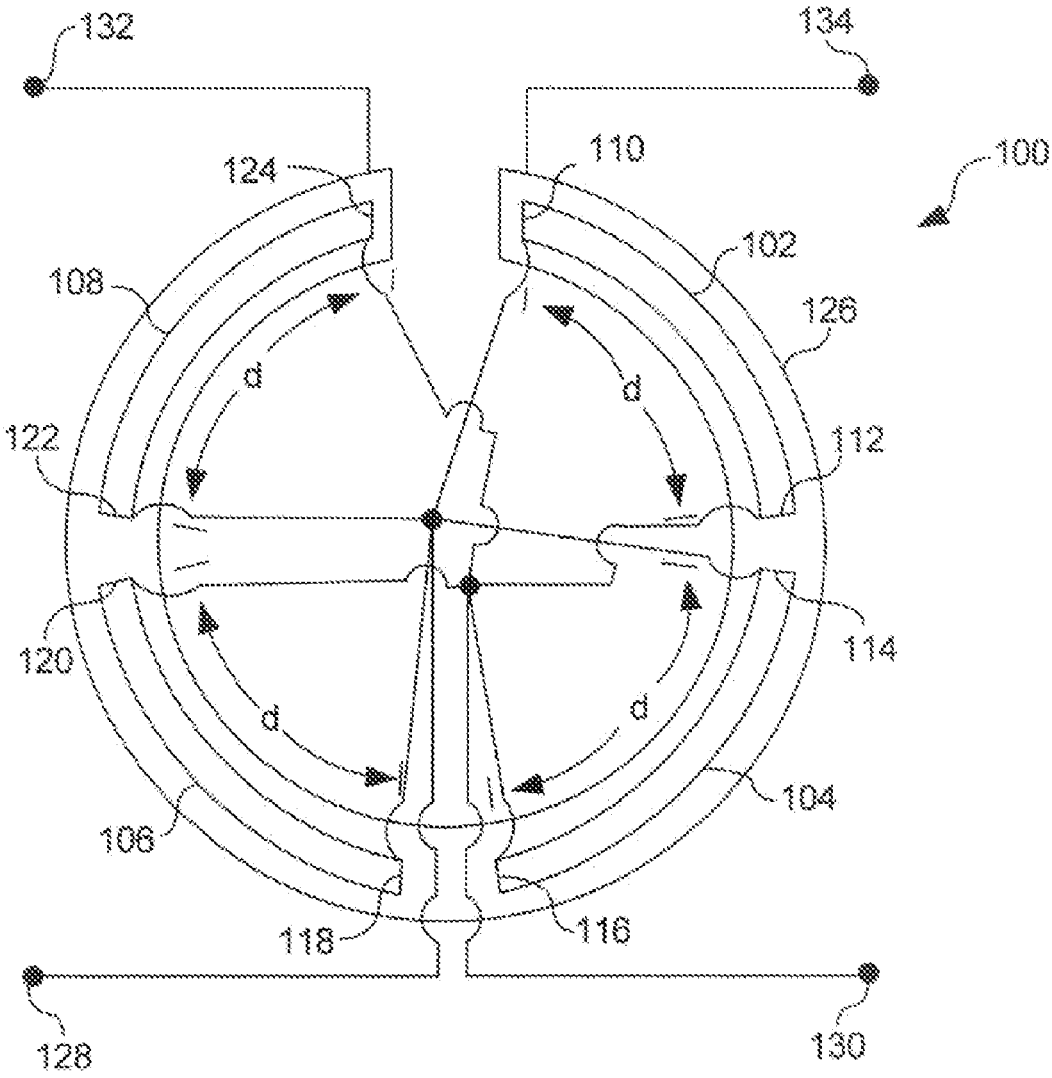
FIG. 2 is a conceptual drawing which is useful for understanding how the various coils of the step-up toroidal transformer shown in FIG. 1 can be arranged on a toroidal core.

Referring now to FIG. 2, there is shown a conceptual implementation of the electrical circuit shown in FIG. 1. In FIG. 2, it can be observed that each of the plurality of primary coil segments 102, 104, 106, 108 extends a predetermined distance d along the circumference of the toroidal shaped core, which is omitted from FIG. 2 for greater clarity. In FIG. 2, some spacing is shown between each of the primary coil segments 102, 104, 106, 108 for greater clarity. However, it should be understood that the primary coil segments 102, 104, 106, 108 collectively extend in a substantially continuous manner an entire distance around the circumference of the toroidal shaped core.

FIG. 2 also shows the first primary input terminal 128 and the second primary input terminal 130. Each of the plurality of primary coil segments 102, 104, 106, 108 is electrically connected in parallel across the first primary input terminal and the second primary input terminal as shown. More particularly, the first end 110, 114, 118, 122 of each primary coil segment 102, 104, 106, 108 is electrically connected to the first primary input terminal 128 and the second end 112, 116, 120, 124 of each primary coil segment 102, 104, 106, 108 is electrically connected to the second primary input terminal 130.

In FIG. 2, it can also be observed that the plurality of primary coil segments 102, 104, 106, 108 are arranged so that the first end 110, 114, 116, 122 of each primary coil segment is positioned circumferentially adjacent to the second end 112, 116, 120, 124 of an adjacent one of the primary coil segments. For example, first end 114 of primary coil segment 104 is circumferentially adjacent to second end 112 of primary coil segment 102.

Referring again to FIG. 2, it can be observed that the secondary winding, 126 is formed of a continuous coil that extends substantially the entire distance along the circumference of the toroidal shaped core 136. The primary coil segments 102, 104, 106, 108 are contained within a toroidal volume defined by the turns of the secondary coil 126. According to a preferred embodiment, the primary coil segments 102, 104, 106, 108 are arranged and positioned on the toroidal shaped core 136 so that the magnetic field produced by the primary coil segments is substantially constrained within the toroidal shaped core. The secondary is preferably designed such that its total number of turns around the toroidal shaped core are equal (or approximately equal) to the total number of turns which are collectively provided by the primary coil segments 102, 104, 106, 108.

Figure 3:
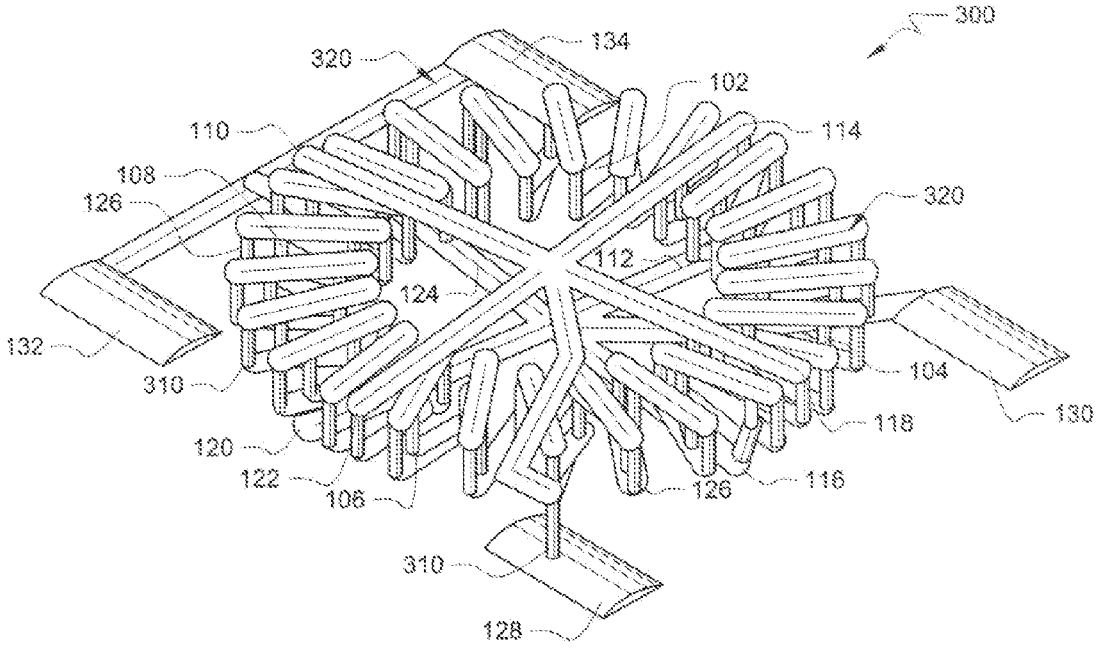
FIG. 3 is a perspective view showing an arrangement of the primary and secondary windings of the step-up toroidal transformer FIGS. 1 and 2.

Referring now to FIG. 3, there is shown a perspective view of a step-up toroidal transformer 300 that follows the circuit design illustrated in FIGS. 1 and 2. The step-up toroidal transformer comprises a primary winding comprised of a plurality of primary coil segments 102, 104, 106, 108 and a secondary winding 126. The primary winding is contained within the toroidal volume defined by the turns of the secondary coil 126. Although not shown for clarity purposes, the step-up toroidal transformer can be partially embedded within a ceramic substrate.

In order to at least partially embed the coils of the primary winding and secondary winding in a substrate, the coils can be formed by a combination of conductive vias 310 and conductive traces 320 disposed on the substrate (not shown). Such techniques of forming embedded transformers are disclosed in U.S. Published Patent Application No. 2005/0212642 to Pleskach, the entirety of which is incorporated herein by reference.

Figure 4:
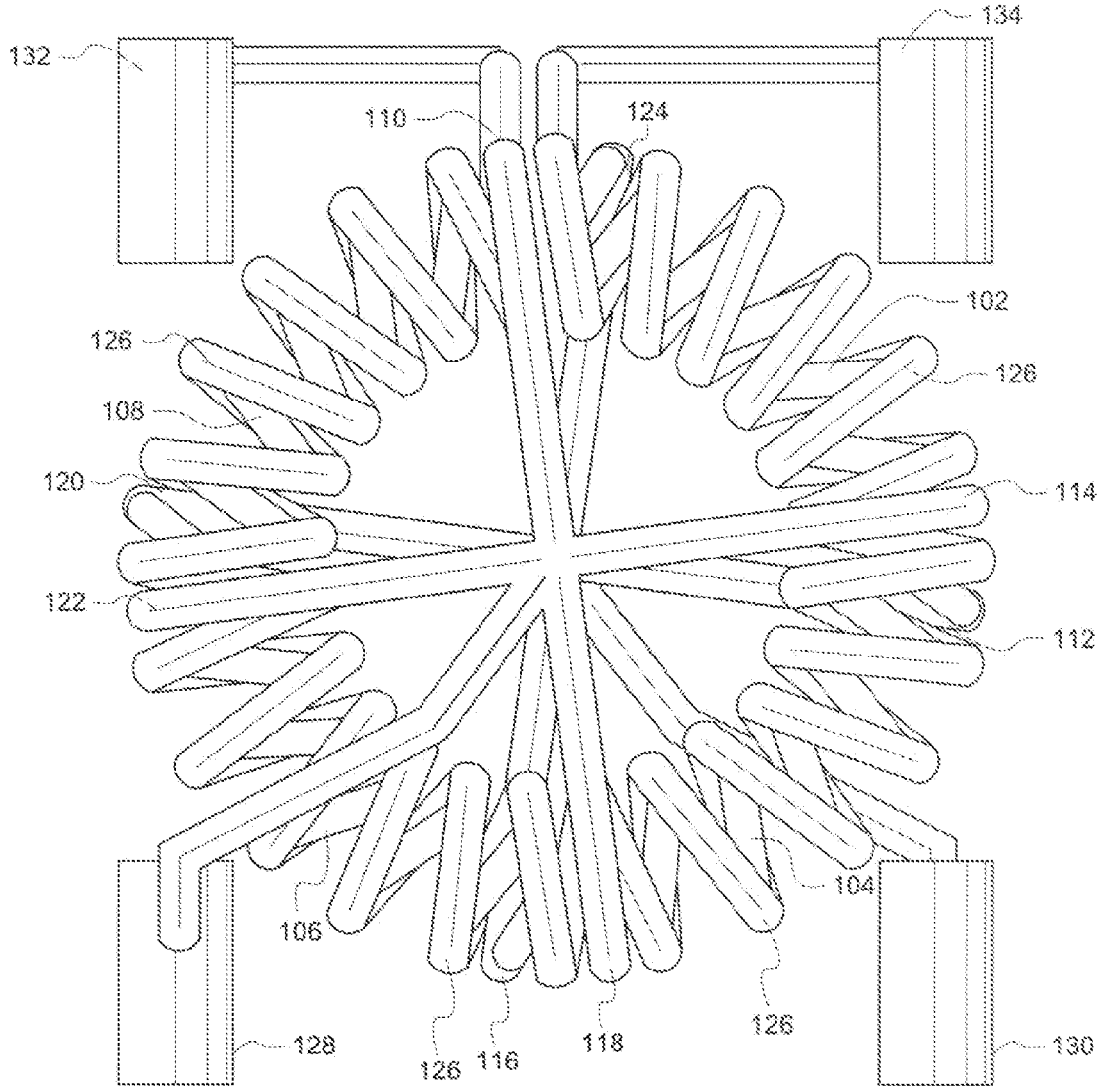
FIG. 4 is a top plan view showing an arrangement of the primary and secondary windings of the step-up toroidal transformer in FIGS. 1-3.

Referring now to FIG. 4, there is shown a top plan view of the step-up toroidal transformer illustrated in FIG. 3. As can be seen in FIG. 4, the number of turns formed by the combination of the four primary coil segments 102, 104, 106, 108 collectively form an approximately equivalent number of turns about the toroidal shaped core (not shown) as compared to the secondary winding 102.

Figure 5:
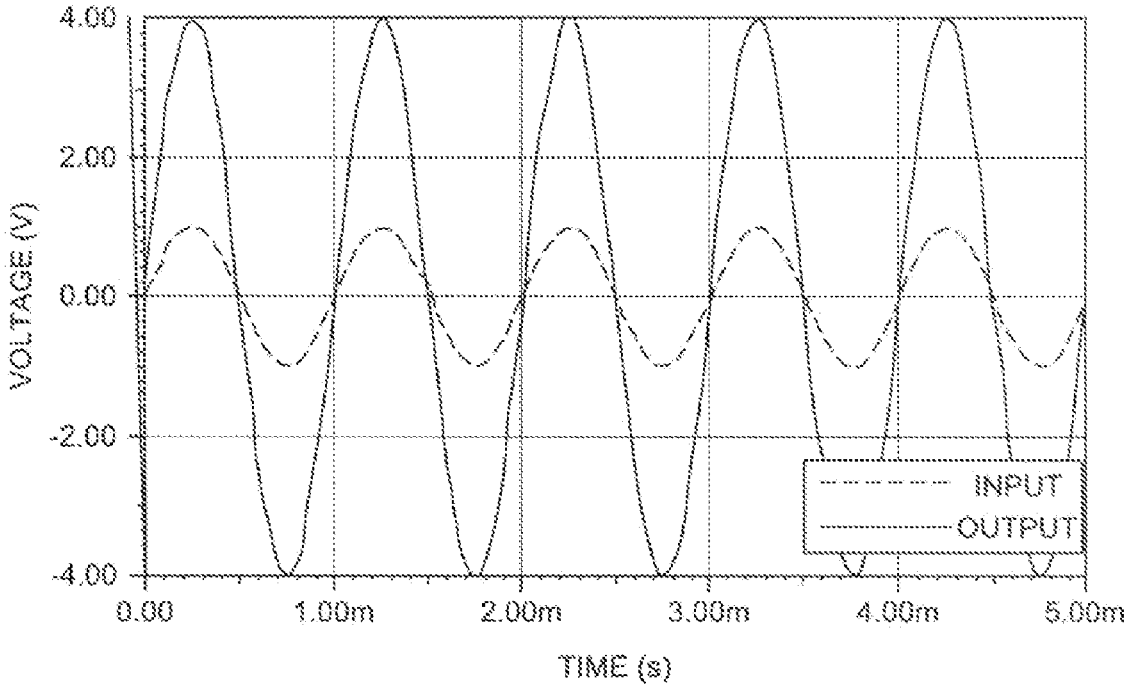
FIG. 5 is a diagram showing the voltage response over time of the step-up toroidal transformer that is useful for understanding the invention.

Referring now to FIG. 5, shown is a diagram showing the voltage response over time of the step-up toroidal transformer example described in FIGS. 1-4. For purposes of this example, it is assumed that the step-up toroidal transformer has been designed to have a modified turns ratio (primary winding divided by secondary winding times the number of primary segments, $(N_p/N_s)*(1/s)$ of 1:4. When a 1V peak to peak sinusoidal input voltage $V_p$ is applied between each of the four primary coil segments, the resulting stepped-up voltage $V_S$ across the terminals of the secondary winding will be approximately four times the input voltage value, or 4V, peak to peak. It is important to note that the voltage response over time of the embedded step-up toroidal transformer depends not only on the turns ratio that the circuit is designed for. Other factors that can affect voltage response include, but are not limited to, the operating frequency of the signal, and the material properties of the substrate.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A step-up toroidal transformer, comprising:

a plurality of primary coil segments, each separately comprised of a plurality of turns of an elongated conductor coiled around a toroidal shaped core, said plurality of primary coil segments collectively disposed around a circumference defined by said toroidal shaped core;

a first primary input terminal and a second primary input terminal, each of said plurality of primary coil segments electrically connected in parallel across said first primary input terminal and said second primary input terminal;

a second winding formed from a plurality of turns of a second elongated conductor coiled around said toroidal shaped core, said secondary winding extending around said circumference.

2. The step-up toroidal transformer according to claim 1, wherein said plurality of primary coil segments collectively extend an entire distance around said circumference and wherein said secondary winding extends an entire distance around said circumference.

3. The step-up toroidal transformer according to claim 1, wherein at least one of said primary coil segments and said secondary winding is at least partially embedded in a circuit board.

4. The step-up toroidal transformer according to claim 3, wherein said primary coil segments and said secondary winding are comprised of a plurality of vias disposed within said circuit board.

5. The step-up toroidal transformer according to claim 4, wherein selected ones of said vias are electrically connected with conductive traces disposed in or on said circuit board.

6. The step-up toroidal transformer according to claim 1, wherein said primary coil segments collectively comprise an approximately equivalent number of turns about said toroidal shaped core as compared to said secondary winding.

7. The step-up toroidal transformer according to claim 1, wherein a first end of each said primary coil segment is electrically connected to said first primary input terminal and a second end of each said primary coil segment is electrically connected to said second primary input terminal, and said plurality of primary coil segments are arranged on said toroidal shaped core so that said first end of each primary coil segments is positioned circumferentially adjacent to said second end of an adjacent one of said primary coil segments.

8. The step-up toroidal transformer according to claim 1, wherein said turns of said plurality of primary coil segments are contained within a toroidal volume defined by said turns of said secondary winding.

9. The step-up toroidal transformer according to claim 1, wherein said turns of said secondary winding is contained within a toroidal volume defined by said turns of said primary coil segments.

10. The step-up toroidal transformer according to claim 1, wherein the total number of turns of the primary coil segments are equal to the total number of turns of the secondary winding and a modified turns ratio of said toroidal transformer is determined by the number of said primary coil segments connected in parallel.

11. The step-up toroidal transformer according to claim 1, wherein said plurality of primary coil segments are arranged and positioned on said toroidal shaped core so that a magnetic field produced by said plurality of primary coil segments is substantially constrained within said toroidal shaped core.

12. The step-up transformer according to claim 1, wherein said plurality of primary coil segments and said secondary winding constrain a magnetic field produced by said plurality of primary coil segments and said secondary winding.

13. A step-up toroidal transformer, comprising:

a plurality of primary coil segments positioned circumferentially adjacent to each other and respectively coiled about a common toroidal shaped core, said plurality of coil segments collectively extending substantially around an entire circumference defined by said toroidal shaped core;

a first primary input terminal and a second primary input terminal, each of said plurality of coil segments electrically connected in parallel across said first primary input terminal and said second primary input terminal;

a secondary winding formed around said toroidal shaped core, said secondary winding extending substantially around said entire circumference of said toroidal shaped core.

14. The step up toroidal transformer according to claim 13, wherein a first end of each said primary coil segment is electrically connected to said first primary input terminal and a second end of each said primary coil segment is electrically connected to said second primary input terminal, and said plurality of primary coil segments are arranged on said toroidal shaped core so that said first end of each primary coil segment is positioned circumferentially adjacent to said second end of an adjacent one of said primary coil segments.

15. The step up toroidal transformer according to claim 13, wherein at least one of said primary coil segments and said secondary winding is at least partially embedded in a circuit board.

16. The step-up toroidal transformer according to claim 13, wherein said plurality of primary coil segments and said secondary winding constrain a magnetic field produced by said plurality of primary coil segments and said secondary winding.

17. A step-up toroidal transformer, comprising:

a plurality of primary coil segments, each separately comprised of a plurality of turns of an elongated conductor coiled around a toroidal shaped core, said plurality of coil segments collectively disposed around a circumference defined by said toroidal shaped core;

a first primary input terminal and a second primary input terminal, each of said plurality of coil segments electrically connected in parallel across said first primary input terminal and said second primary input terminal;

a secondary winding formed from a plurality of turns of a second elongated conductor coiled around said toroidal shaped core, said secondary winding extending around said circumference;

wherein said primary coil segments collectively comprise an approximately equivalent number of turns about said toroidal shaped core as compared to said secondary winding, and a turn ratio of said toroidal transformer is determined by the number of said primary coil segments.

18. The step-up toroidal transformer according to claim 17, wherein said plurality of primary coil segments and said secondary winding constrain a magnetic field produced by said plurality of primary coil segments and said secondary winding.

* * * * *